US008578675B2

(12) United States Patent
Palsson et al.

(10) Patent No.: US 8,578,675 B2
(45) **Date of Patent: *Nov. 12, 2013**

(54) PROCESS FOR SEALING OF A JOINT

(75) Inventors: Jorgen Palsson, Landskrona (SE); Ake Sjoberg, Lund (SE)

(73) Assignee: Pergo (Europe) AB, Trelleborg (SE)

( * ) Notice: Subject to any disclaimer, the term of this patent is extended or adjusted under 35 U.S.C. 154(b) by 350 days.

This patent is subject to a terminal disclaimer.

(21) Appl. No.: 12/010,587

(22) Filed: Jan. 28, 2008

(65) Prior Publication Data

US 2008/0271403 A1 Nov. 6, 2008

Related U.S. Application Data

(60) Division of application No. 10/242,674, filed on Sep. 13, 2002, now Pat. No. 7,332,053, which is a continuation-in-part of application No. 09/988,014, filed on Nov. 16, 2001, now abandoned, and a continuation-in-part of application No. 09/672,076, filed on Sep. 29, 2000, now Pat. No. 6,591,568.

(30) Foreign Application Priority Data

Mar. 31, 2000 (SE) ..... 0001149

(51) Int. Cl.
*E04B 2/00* (2006.01)

(52) U.S. Cl.
USPC ..... 52/592.2; 52/591.5

(58) Field of Classification Search
USPC ..... 52/581, 589.1, 592.1, 592.2
See application file for complete search history.

(56) References Cited

U.S. PATENT DOCUMENTS

| | | | |
|---|---|---|---|
| 208,036 | A | 9/1878 | Robley |
| 213,740 | A | 4/1879 | Conner |
| 308,313 | A | 11/1884 | Gerike |
| 342,529 | A | 5/1886 | McRae |
| 662,458 | A | 11/1900 | Nagel |
| 714,987 | A | 12/1902 | Wolfe |
| 752,694 | A | 2/1904 | Lund |
| 753,791 | A | 3/1904 | Fulghum |

(Continued)

FOREIGN PATENT DOCUMENTS

| | | |
|---|---|---|
| AT | 002214 | 1/1975 |
| AU | 199732569 | 12/1999 |

(Continued)

OTHER PUBLICATIONS

U.S. Appl. No. 09/672,077, filed Jul. 2000.

(Continued)

*Primary Examiner* — Jessica Laux
(74) *Attorney, Agent, or Firm* — Jenkins, Wilson, Taylor & Hunt, P.A.

(57) ABSTRACT

A process for installation of surface elements (1), the surface elements (1) comprising a core, a decorative upper surface (3) and edges (2) provided with joining means for mechanically locking the surface elements (1) together. Predetermined portions of the edges (2) are provided with a glue which is present on the edges (2) of the surface elements (1) in a passive dry form and which may be activated by applying a liquid. The surface elements (1) are joined to each other by use of the joining means wherein a unit of a plurality of surface elements (1) is formed.

15 Claims, 3 Drawing Sheets

(56) References Cited

U.S. PATENT DOCUMENTS

| | | | |
|---|---|---|---|
| 769,355 | A | 9/1904 | Platow |
| 832,003 | A | 9/1906 | Torrence |
| 847,272 | A | 3/1907 | Ayers |
| 877,639 | A | 1/1908 | Galbraith |
| 898,381 | A | 9/1908 | Mattison |
| 1,000,859 | A | 8/1911 | Vaughan |
| 1,002,102 | A | 8/1911 | Weedon |
| 1,016,383 | A | 2/1912 | Wellman |
| 1,097,986 | A | 5/1914 | Moritz |
| 1,124,226 | A | 1/1915 | Houston |
| 1,124,228 | A | 1/1915 | Houston |
| 1,137,197 | A | 4/1915 | Ellis |
| 1,140,958 | A | 5/1915 | Cowan |
| 1,266,253 | A | 5/1918 | Hakason |
| 1,319,286 | A | 10/1919 | Johnson et al. |
| 1,357,713 | A | 11/1920 | Lane |
| 1,407,679 | A | 2/1922 | Ruchrauff |
| 1,454,250 | A | 5/1923 | Parsons |
| 1,468,288 | A | 9/1923 | Fen |
| 1,510,924 | A | 10/1924 | Daniels et al. |
| 1,540,128 | A | 6/1925 | Houston |
| 1,575,821 | A | 3/1926 | Daniels |
| 1,576,527 | A | 3/1926 | McBride |
| 1,576,821 | A | 3/1926 | Daniels |
| 1,602,256 | A | 10/1926 | Sellin |
| 1,602,267 | A | 10/1926 | Karwiside |
| 1,615,096 | A | 1/1927 | Myers |
| 1,622,103 | A | 3/1927 | Fulton |
| 1,622,104 | A | 3/1927 | Fulton |
| 1,637,634 | A | 8/1927 | Carter |
| 1,644,710 | A | 10/1927 | Crooks |
| 1,657,159 | A | 1/1928 | Greenebaum |
| 1,660,480 | A | 2/1928 | Daniels |
| 1,706,924 | A | 3/1929 | Kane |
| 1,714,738 | A | 5/1929 | Smith |
| 1,718,702 | A | 6/1929 | Pflester |
| 1,734,826 | A | 11/1929 | Pick |
| 1,736,539 | A | 11/1929 | Lachman |
| 1,764,331 | A | 6/1930 | Moratz |
| 1,772,417 | A | 8/1930 | Ellinwood |
| 1,776,188 | A | 9/1930 | Langbaum |
| 1,823,039 | A | 9/1930 | Gruner |
| 1,778,069 | A | 10/1930 | Fetz |
| 1,787,027 | A | 12/1930 | Wasleff |
| 1,801,093 | A | 4/1931 | Larkins |
| 1,843,024 | A | 1/1932 | Werner |
| 1,854,396 | A | 4/1932 | Davis |
| 1,859,667 | A | 5/1932 | Gruner |
| 1,898,364 | A | 2/1933 | Gynn |
| 1,906,411 | A | 5/1933 | Potvin |
| 1,913,342 | A | 6/1933 | Schaffert |
| 1,929,871 | A | 10/1933 | Jones |
| 1,940,377 | A | 12/1933 | Storm |
| 1,953,306 | A | 4/1934 | Moratz |
| 1,966,020 | A | 7/1934 | Rowley |
| 1,978,075 | A | 10/1934 | Butterworth |
| 1,986,739 | A | 1/1935 | Mitte |
| 1,988,201 | A | 1/1935 | Hall |
| 1,991,701 | A | 2/1935 | Roman |
| 2,004,193 | A | 6/1935 | Cherry |
| 2,015,813 | A | 10/1935 | Nielsen |
| 2,027,292 | A | 1/1936 | Rockwell |
| 2,044,216 | A | 6/1936 | Klages |
| 2,045,067 | A | 6/1936 | Bruce |
| 2,049,571 | A | 8/1936 | Schuck |
| 2,100,238 | A | 11/1937 | Burgess |
| 2,126,956 | A | 8/1938 | Gilbert |
| 2,138,085 | A | 11/1938 | Birtles |
| 2,141,708 | A | 12/1938 | Elmendorf |
| 2,142,305 | A | 1/1939 | Davis |
| 2,194,086 | A | 3/1940 | Horn |
| 2,199,938 | A | 5/1940 | Kloote |
| 2,222,137 | A | 11/1940 | Bruce |
| 2,238,169 | A | 4/1941 | Heyn et al. |
| 2,245,497 | A | 6/1941 | Potchen |
| 2,253,943 | A | 8/1941 | Rice |
| 2,266,464 | A | 12/1941 | Kraft |
| 2,276,071 | A | 3/1942 | Scull |
| 2,280,071 | A | 4/1942 | Hamilton |
| 2,282,559 | A | 5/1942 | Byers |
| 2,324,628 | A | 7/1943 | Kahr |
| 2,363,429 | A | 11/1944 | Lowry |
| 2,398,632 | A | 4/1946 | Frost et al. |
| 2,405,602 | A | 8/1946 | Nugent |
| 2,430,200 | A | 11/1947 | Wilson |
| 2,487,571 | A | 11/1949 | Maxwell |
| 2,491,498 | A | 12/1949 | Kahr |
| 2,644,552 | A | 7/1953 | MacDonald |
| 2,717,420 | A | 9/1955 | Georges |
| 2,729,584 | A | 1/1956 | Foster |
| 2,740,167 | A | 4/1956 | Rowley |
| 2,780,253 | A | 2/1957 | Joa |
| 2,808,624 | A | 10/1957 | Sullivan |
| 2,823,433 | A | 2/1958 | Kendall |
| 2,839,790 | A | 6/1958 | Collings |
| 2,857,302 | A | 10/1958 | Burton et al. |
| 2,863,185 | A | 12/1958 | Reidi |
| 2,865,058 | A | 12/1958 | Andersson et al. |
| 2,878,530 | A | 3/1959 | Hilding |
| 2,894,292 | A | 7/1959 | Gramelspacher |
| 2,926,401 | A | 3/1960 | Place |
| 2,831,223 | A | 9/1960 | DeShazor |
| 2,952,341 | A | 9/1960 | Weiler |
| 2,996,751 | A | 8/1961 | Roby |
| 3,045,294 | A | 7/1962 | Livezey, Jr. |
| 3,090,082 | A | 5/1963 | Bauman |
| 3,100,556 | A | 8/1963 | Ridder |
| 3,125,138 | A | 3/1964 | Bolenbach |
| 3,128,851 | A | 4/1964 | Deridder et al. |
| 3,141,392 | A | 7/1964 | Schneider |
| 3,148,482 | A | 9/1964 | Neale |
| 3,162,906 | A | 12/1964 | Dudley |
| 3,182,769 | A | 5/1965 | De Ridder |
| 3,199,258 | A | 8/1965 | Jentfot et al. |
| 3,203,149 | A | 8/1965 | Soddy |
| 3,204,380 | A | 9/1965 | Wilson |
| 3,253,377 | A | 5/1966 | Schakel |
| 3,257,225 | A | 6/1966 | Marotta et al. |
| 3,267,630 | A | 8/1966 | Omholt |
| 3,282,010 | A | 11/1966 | King, Jr. |
| 3,286,425 | A | 11/1966 | Brown |
| 3,296,056 | A | 1/1967 | Bechtold |
| 3,301,147 | A | 1/1967 | Aluminum |
| 3,310,919 | A | 3/1967 | Bue |
| 3,331,171 | A | 7/1967 | Hallcock |
| 3,339,329 | A | 9/1967 | Berg |
| 3,347,048 | A | 10/1967 | Brown et al. |
| 3,362,127 | A | 1/1968 | McGowan |
| 3,363,381 | A | 1/1968 | Forrest |
| 3,363,382 | A | 1/1968 | Forrest |
| 3,363,383 | A | 1/1968 | La Barge |
| 3,373,071 | A | 3/1968 | Fuerst |
| 3,377,931 | A | 4/1968 | Hilton |
| 3,387,422 | A | 6/1968 | Wanzer |
| 3,397,496 | A | 8/1968 | Sohns |
| 3,444,660 | A | 5/1969 | Feichter |
| 3,449,879 | A | 6/1969 | Bloom |
| 3,460,304 | A | 8/1969 | Braeuninger et al. |
| 3,473,278 | A | 10/1969 | Gossen |
| 3,474,584 | A | 10/1969 | Lynch |
| 3,479,784 | A | 11/1969 | Massagli |
| 3,481,810 | A | 12/1969 | Waite |
| 3,488,828 | A | 1/1970 | Gallagher |
| 3,496,119 | A | 2/1970 | Weller et al. |
| 3,508,369 | A | 4/1970 | Tennison |
| 3,526,420 | A | 9/1970 | Brancaleone |
| 3,535,844 | A | 10/1970 | Glaros |
| 3,538,665 | A | 11/1970 | Gohner |
| 3,538,819 | A | 11/1970 | Gould et al. |
| 3,553,919 | A | 1/1971 | Omholt |
| 3,555,762 | A | 1/1971 | Costanzo, Jr. |
| 3,570,205 | A | 3/1971 | Payne |
| 3,572,224 | A | 3/1971 | Perry |
| 3,579,941 | A | 5/1971 | Tibbals |

(56) References Cited

U.S. PATENT DOCUMENTS 3,619,964 A 11/1971 Passaro et al.
3,627,362 A 12/1971 Brenneman
3,657,852 A 4/1972 Worthington et al.
3,665,666 A 5/1972 Delcroix
3,671,369 A 6/1972 Kvalheim et al.
3,687,773 A 8/1972 Wangborg
3,694,983 A 10/1972 Couquet
3,696,575 A 10/1972 Armstrong
3,707,061 A 12/1972 Collette et al.
3,714,747 A 2/1973 Curran
3,720,027 A 3/1973 Christensen
3,731,445 A 5/1973 Hoffmann et al.
3,745,726 A 7/1973 Thom
3,758,650 A 9/1973 Hurst
3,759,007 A 9/1973 Thiele
3,760,544 A 9/1973 Hawes et al.
3,768,846 A 10/1973 Hensley et al.
3,778,958 A 12/1973 Fowler
3,798,111 A 3/1974 Lane et al.
3,807,113 A 4/1974 Turner
3,808,030 A 4/1974 Bell
3,810,707 A 5/1974 Tungseth et al.
3,849,240 A 11/1974 Mikulak
3,859,000 A 1/1975 Webster
3,884,328 A 5/1975 Williams
3,902,293 A 9/1975 Witt et al.
3,908,053 A 9/1975 Hettich
3,908,062 A 9/1975 Roberts
3,921,312 A 11/1975 Fuller
3,936,551 A 2/1976 Elmendorf et al.
3,953,661 A 4/1976 Gulley
3,988,187 A 10/1976 Witt et al.
4,059,933 A 11/1977 Funk et al.
4,060,437 A 11/1977 Strout
4,065,902 A 1/1978 Lindal
4,067,155 A 1/1978 Ruff et al.
4,074,496 A 2/1978 Fischer
4,090,338 A 5/1978 Bourgade
4,099,358 A 7/1978 Compaan
4,144,689 A 3/1979 Bains
4,150,517 A 4/1979 Warner
4,158,335 A 6/1979 Belcastro
4,164,832 A 8/1979 Van Zandt
4,169,688 A 10/1979 Toshio
4,186,539 A 2/1980 Harmon et al.
4,198,455 A 4/1980 Spiro et al.
4,242,390 A 12/1980 Nemeth
4,247,390 A 1/1981 Knoll
4,292,774 A 10/1981 Mairle
4,299,070 A 11/1981 Oltmanns et al.
4,316,351 A 2/1982 Ting
4,376,593 A 3/1983 Schaefer
4,390,580 A 6/1983 Donovan et al.
4,426,820 A * 1/1984 Terbrack et al. ..... 52/590.1
4,449,346 A 5/1984 Tremblay
4,455,803 A 6/1984 Kornberger
4,461,131 A 7/1984 Pressell
4,471,012 A 9/1984 Maxwell
4,501,102 A 2/1985 Knowles
4,504,347 A 3/1985 Munk et al.
4,505,887 A 3/1985 Miyata et al.
4,520,062 A 5/1985 Ungar et al.
4,561,233 A 12/1985 Harter et al.
4,571,910 A 2/1986 Cosentino
4,594,347 A 6/1986 Ishikawa et al.
4,599,124 A 7/1986 Kelly et al.
4,599,841 A 7/1986 Haid
4,599,842 A 7/1986 Counihan
4,612,745 A 9/1986 Hovde
4,621,471 A 11/1986 Kuhr et al.
4,641,469 A 2/1987 Wood
4,643,237 A 2/1987 Rosa
4,653,138 A 3/1987 Carder
4,653,242 A 3/1987 Ezard
4,672,728 A 6/1987 Nimberger
4,683,631 A 8/1987 Dobbertin
4,703,597 A 11/1987 Eggemar
4,715,162 A 12/1987 Brightwell
4,733,510 A 3/1988 Werner
4,736,563 A 4/1988 Bilhorn
4,738,071 A 4/1988 Ezard
4,747,197 A 5/1988 Charron
4,757,657 A 7/1988 Mitchell
4,757,658 A 7/1988 Kaempen
4,769,963 A 9/1988 Meyerson
4,796,402 A 1/1989 Pajala
4,806,435 A 2/1989 Athey
4,819,932 A 4/1989 Trotter, Jr.
4,831,806 A 5/1989 Niese et al.
4,844,972 A 7/1989 Tedeschi et al.
4,845,907 A 7/1989 Meek
4,893,449 A 1/1990 Kemper
4,894,272 A 1/1990 Aisley
4,905,442 A 3/1990 Daniels
4,910,280 A 3/1990 Robbins, III
4,920,626 A 5/1990 Nimberger
4,940,503 A 7/1990 Lindgren et al.
4,952,775 A 8/1990 Yokoyama et al.
4,953,335 A 9/1990 Kawaguchi et al.
4,988,131 A 1/1991 Wilson et al.
4,998,395 A 3/1991 Bezner
4,998,396 A 3/1991 Palmersten
5,003,016 A 3/1991 Boeder
5,029,425 A 7/1991 Bogataj
5,034,272 A 7/1991 Lindgren et al.
5,050,362 A 9/1991 Tal et al.
5,070,662 A 12/1991 Niese
5,074,089 A 12/1991 Kemmer et al.
5,086,599 A 2/1992 Meyerson
5,092,095 A 3/1992 Zadok et al.
5,113,632 A 5/1992 Hanson
5,117,603 A 6/1992 Weintraub
5,138,812 A 8/1992 Palmersten
5,148,850 A 9/1992 Urbanick
5,155,952 A 10/1992 Herwegh et al.
5,165,816 A 11/1992 Parasin
5,179,811 A 1/1993 Walker et al.
5,179,812 A 1/1993 Hill
5,216,861 A 6/1993 Meyerson
5,244,303 A 9/1993 Hair
5,247,773 A 9/1993 Weir
5,253,464 A 10/1993 Nilsen
5,259,162 A 11/1993 Nicholas
5,271,564 A 12/1993 Smith
5,274,979 A 1/1994 Tsai
5,292,155 A 3/1994 Bell et al.
5,295,341 A 3/1994 Kajiwara
5,325,649 A 7/1994 Kajiwara
5,343,665 A 9/1994 Palmersten
5,344,700 A 9/1994 Mcgath et al.
5,348,778 A 9/1994 Knipp et al.
5,349,796 A 9/1994 Meyerson
5,359,817 A 11/1994 Fulton
5,365,713 A 11/1994 Nicholas et al.
5,390,457 A 2/1995 Sjolander
5,424,118 A 6/1995 McLaughlin
5,433,048 A 7/1995 Strasser
5,433,806 A 7/1995 Pasquali et al.
5,474,831 A 12/1995 Nystrom
5,497,589 A 3/1996 Porter
5,502,939 A 4/1996 Zadok et al.
5,527,128 A 6/1996 Rope et al.
5,540,025 A 7/1996 Takehara et al.
D373,203 S 8/1996 Kornfalt
5,567,497 A 10/1996 Zegler et al.
5,570,554 A 11/1996 Searer
5,581,967 A 12/1996 Glatz
5,597,024 A 1/1997 Bolyard et al.
5,618,602 A 4/1997 Nelson
5,618,612 A 4/1997 Gstrein
5,623,799 A 4/1997 Kowalski
5,630,304 A 5/1997 Austin
5,657,598 A 8/1997 Wilbs et al.
5,671,575 A 9/1997 Wu

(56) References Cited

U.S. PATENT DOCUMENTS 5,685,117 A 11/1997 Nicholson
5,688,569 A 11/1997 Gilmore et al.
5,692,354 A 12/1997 Searer
5,695,875 A 12/1997 Larsson et al.
5,706,621 A * 1/1998 Pervan ..... 52/403.1
5,706,623 A 1/1998 Brown
5,719,239 A 2/1998 Mirous et al.
5,735,092 A 4/1998 Clayton et al.
5,736,227 A 4/1998 Sweet et al.
5,765,808 A 6/1998 Butschbacher et al.
5,791,114 A 8/1998 Mandel
5,797,237 A 8/1998 Finkell, Jr.
5,823,240 A 10/1998 Bolyard et al.
5,827,592 A 10/1998 Van Gulik et al.
5,860,267 A 1/1999 Pervan
5,888,017 A 3/1999 Corrie
5,894,701 A 4/1999 Delorme
5,904,019 A 5/1999 Kooij et al.
5,907,934 A 6/1999 Austin
5,930,947 A 8/1999 Eckhoff
5,931,447 A 8/1999 Butschbacher et al.
5,935,668 A 8/1999 Smith
5,941,047 A 8/1999 Johansson
5,943,239 A 8/1999 Shamblin et al.
5,945,181 A 8/1999 Fisher
5,950,389 A 9/1999 Porter
5,968,625 A 10/1999 Hudson
5,971,655 A 10/1999 Shirakawa
5,987,839 A 11/1999 Hamar et al.
5,987,845 A 11/1999 Laronde
5,996,301 A 12/1999 Conterno
6,006,486 A * 12/1999 Moriau et al. ..... 52/589.1
6,012,263 A 1/2000 Church et al.
6,021,615 A 2/2000 Brown
6,021,646 A 2/2000 Burley
6,023,907 A 2/2000 Pervan
6,029,416 A 2/2000 Andersson
6,079,182 A 6/2000 Ellenberger
6,094,882 A 8/2000 Pervan
6,101,778 A 8/2000 Martensson
6,119,423 A 9/2000 Costantino
6,134,854 A 10/2000 Stanchfield
6,141,920 A 11/2000 Kemper
6,143,119 A 11/2000 Seidner
6,148,884 A 11/2000 Bolyard et al.
6,158,915 A 12/2000 Kise
6,182,410 B1 2/2001 Pervan
6,182,413 B1 2/2001 Magnusson
6,189,283 B1 2/2001 Bentley
6,205,639 B1 3/2001 Pervan
6,209,278 B1 4/2001 Tychsen
6,216,403 B1 4/2001 Belbeoc'h
6,216,409 B1 4/2001 Roy et al.
6,219,982 B1 4/2001 Eyring
6,230,385 B1 5/2001 Nelson
6,233,899 B1 5/2001 Mellert et al.
6,247,285 B1 6/2001 Moebus
6,253,514 B1 7/2001 Jobe et al.
6,314,701 B1 11/2001 Meyerson
6,324,803 B1 12/2001 Pervan
6,324,809 B1 12/2001 Nelson
6,332,733 B1 12/2001 Hamberger et al.
6,345,480 B1 2/2002 Kemper
6,345,481 B1 2/2002 Nelson
6,363,677 B1 4/2002 Chen et al.
6,365,258 B1 4/2002 Alm
6,385,936 B1 5/2002 Schneider
6,397,547 B1 6/2002 Martensson
6,418,683 B1 7/2002 Martensson et al.
6,421,970 B1 7/2002 Martensson et al.
6,423,257 B1 7/2002 Stobart
6,438,919 B1 8/2002 Knauseder
6,446,405 B1 9/2002 Pervan
6,505,452 B1 1/2003 Haanig et al.
6,510,665 B2 1/2003 Pervan
6,516,579 B1 2/2003 Pervan
6,517,935 B1 2/2003 Kornfalt et al.
6,532,709 B2 3/2003 Pervan
6,550,205 B2 4/2003 Neuhofer
6,588,165 B1 7/2003 Wright
6,591,568 B1 7/2003 Paalsson
6,601,359 B2 8/2003 Olofsson
6,606,834 B2 8/2003 Martensson et al.
6,647,690 B1 * 11/2003 Martensson ..... 52/601
6,672,030 B2 1/2004 Schulte
6,681,820 B2 1/2004 Olofsson
6,682,254 B1 1/2004 Olofsson
6,711,869 B2 3/2004 Tychsen
6,729,091 B1 5/2004 Martensson
6,745,534 B2 6/2004 Kornfalt
6,763,643 B1 * 7/2004 Martensson ..... 52/586.1
6,769,219 B2 8/2004 Schwitte et al.
6,769,835 B2 8/2004 Stridsman
6,786,016 B1 9/2004 Wood
6,805,951 B2 10/2004 Kornfalt et al.
6,851,241 B2 2/2005 Pervan
6,854,235 B2 2/2005 Martensson
6,860,074 B2 3/2005 Stanchfield
6,880,305 B2 4/2005 Pervan et al.
6,880,307 B2 * 4/2005 Schwitte et al. ..... 52/592.1
6,898,913 B2 5/2005 Pervan
6,920,732 B2 7/2005 Martensson
6,931,798 B1 8/2005 Pocai
6,966,161 B2 11/2005 Palsson et al.
RE38,950 E 1/2006 Maiers et al.
7,021,019 B2 4/2006 Knauseder
7,086,205 B2 8/2006 Pervan
7,121,058 B2 10/2006 Palsson et al.
7,121,059 B2 10/2006 Pervan
7,131,242 B2 11/2006 Martensson
7,152,507 B2 12/2006 Solari
7,210,272 B2 5/2007 Friday
7,332,053 B2 2/2008 Palsson et al.
7,347,328 B2 3/2008 Hartwall
7,398,628 B2 7/2008 Van Horne
7,441,385 B2 * 10/2008 Palsson et al. ..... 52/589.1
7,451,578 B2 11/2008 Hannig
7,552,568 B2 6/2009 Palsson et al.
7,603,826 B1 10/2009 Moebus
7,634,884 B2 * 12/2009 Pervan et al. ..... 52/582.1
7,726,088 B2 6/2010 Muehlebach
7,856,784 B2 12/2010 Martensson
7,877,956 B2 2/2011 Martensson
7,980,039 B2 7/2011 Groeke et al.
7,980,043 B2 7/2011 Moebus
8,028,486 B2 10/2011 Pervan et al.
8,037,657 B2 10/2011 Sjoberg et al.
8,038,363 B2 10/2011 Hannig et al.
8,117,795 B2 2/2012 Knauseder
8,146,318 B2 4/2012 Palsson
8,234,834 B2 8/2012 Martensson et al.
8,276,342 B2 10/2012 Martensson
8,402,709 B2 3/2013 Martensson
2001/0029720 A1 10/2001 Pervan
2002/0007608 A1 1/2002 Pervan
2002/0046526 A1 * 4/2002 Knauseder ..... 52/581
2002/0046528 A1 4/2002 Pervan et al.
2002/0095895 A1 7/2002 Daly et al.
2002/0100242 A1 8/2002 Olofsson
2002/0112433 A1 8/2002 Pervan
2002/0127374 A1 9/2002 Spratling
2002/0148551 A1 10/2002 Knauseder
2002/0178673 A1 12/2002 Pervan
2002/0178674 A1 12/2002 Pervan
2002/0178681 A1 12/2002 Zancai et al.
2002/0178682 A1 12/2002 Pervan
2002/0189747 A1 12/2002 Steinwender
2003/0009972 A1 1/2003 Pervan et al.
2003/0024199 A1 2/2003 Pervan et al.
2003/0033784 A1 2/2003 Pervan
2003/0084634 A1 5/2003 Stanchfield
2003/0084636 A1 5/2003 Pervan
2003/0118812 A1 6/2003 Kornfalt
2003/0141004 A1 7/2003 Palmblad

(56) References Cited

U.S. PATENT DOCUMENTS

| | | | | |
|---|---|---|---|---|
| 2003/0145540 | A1 | 8/2003 | Brunedal | |
| 2003/0154678 | A1 | 8/2003 | Stanchfield | |
| 2003/0159389 | A1 | 8/2003 | Kornfalt | |
| 2003/0224147 | A1 | 12/2003 | Maine et al. | |
| 2004/0016197 | A1 | 1/2004 | Ruhdorfer | |
| 2004/0031225 | A1 | 2/2004 | Fowler | |
| 2004/0031226 | A1 | 2/2004 | Miller | |
| 2004/0031227 | A1 | 2/2004 | Knauseder | |
| 2004/0040235 | A1 | 3/2004 | Kurtz | |
| 2004/0041225 | A1 | 3/2004 | Nemoto | |
| 2004/0139678 | A1 | 7/2004 | Pervan | |
| 2004/0182036 | A1 | 9/2004 | Sjoberg et al. | |
| 2004/0191461 | A1 | 9/2004 | Riccobene | |
| 2004/0211143 | A1* | 10/2004 | Hanning | 52/578 |
| 2005/0034405 | A1 | 2/2005 | Pervan | |
| 2005/0144881 | A1 | 7/2005 | Tate | |
| 2005/0166526 | A1 | 8/2005 | Stanchfield | |
| 2005/0210810 | A1 | 9/2005 | Pervan | |
| 2005/0252130 | A1 | 11/2005 | Martensson | |
| 2006/0101769 | A1* | 5/2006 | Pervan et al. | 52/591.1 |
| 2006/0236642 | A1 | 10/2006 | Pervan | |
| 2006/0248836 | A1 | 11/2006 | Martensson | |
| 2007/0006543 | A1 | 1/2007 | Engstrom | |
| 2007/0028547 | A1* | 2/2007 | Grafenauer et al. | 52/586.1 |
| 2007/0240376 | A1 | 10/2007 | Engstrom | |
| 2008/0000186 | A1 | 1/2008 | Pervan et al. | |
| 2008/0134613 | A1 | 6/2008 | Pervan | |
| 2008/0216434 | A1 | 9/2008 | Pervan | |
| 2008/0236088 | A1 | 10/2008 | Hannig | |
| 2009/0019806 | A1 | 1/2009 | Muehlebach | |
| 2009/0064624 | A1 | 3/2009 | Sokol | |
| 2009/0100782 | A1 | 4/2009 | Groeke et al. | |
| 2009/0193748 | A1 | 8/2009 | Boo et al. | |
| 2009/0199500 | A1 | 8/2009 | LeBlang | |
| 2009/0217615 | A1 | 9/2009 | Engstrom | |
| 2010/0031599 | A1 | 2/2010 | Kennedy et al. | |
| 2010/0043333 | A1 | 2/2010 | Hannig | |
| 2010/0058700 | A1 | 3/2010 | LeBlang | |
| 2011/0167751 | A1 | 7/2011 | Engstrom | |
| 2011/0173914 | A1 | 7/2011 | Engstrom | |
| 2011/0271631 | A1 | 11/2011 | Engstrom | |
| 2011/0271632 | A1 | 11/2011 | Cappelle et al. | |
| 2011/0293361 | A1 | 12/2011 | Olofsson | |
| 2012/0042595 | A1 | 2/2012 | De Boe | |
| 2012/0055112 | A1 | 3/2012 | Engstrom | |
| 2012/0216472 | A1 | 8/2012 | Martensson et al. | |
| 2012/0233948 | A1 | 9/2012 | Palsson | |
| 2012/0247053 | A1 | 10/2012 | Martensson | |
| 2012/0291396 | A1 | 11/2012 | Martensson | |
| 2012/0304590 | A1 | 12/2012 | Engstrom | |
| 2013/0042555 | A1 | 2/2013 | Martensson | |
| 2013/0067840 | A1 | 3/2013 | Martensson | |

FOREIGN PATENT DOCUMENTS

| | | |
|---|---|---|
| AU | 200020703 | 6/2000 |
| BE | 417526 | 12/1936 |
| BE | 557844 | 3/1960 |
| BE | 1010339 | 6/1998 |
| BE | 1010487 | 12/1999 |
| CA | 991373 | 6/1976 |
| CA | 1169106 | 6/1984 |
| CA | 2226286 | 12/1997 |
| CA | 2252791 | 5/1999 |
| CA | 2289309 | 11/1999 |
| CH | 200949 | 1/1939 |
| CH | 211677 | 1/1941 |
| CH | 211877 | 1/1941 |
| CH | 562 377 | 5/1975 |
| DE | 209979 | 11/1906 |
| DE | 1212275 | 3/1966 |
| DE | 1985418 | 5/1968 |
| DE | 1534802 | 4/1970 |
| DE | 7102476 | 6/1971 |
| DE | 1534278 | 11/1971 |
| DE | 2101782 | 7/1972 |
| DE | 2145024 | 3/1973 |
| DE | 2159042 | 6/1973 |
| DE | 2238660 | 2/1974 |
| DE | 2251762 | 5/1974 |
| DE | 7402354 | 5/1974 |
| DE | 2616077 | 10/1977 |
| DE | 2917025 | 11/1980 |
| DE | 3104519 | 2/1981 |
| DE | 3041781 | 6/1982 |
| DE | 3214207 | 11/1982 |
| DE | 3246376 | 6/1984 |
| DE | 3304992 | 8/1984 |
| DE | 3306609 | 9/1984 |
| DE | 3319235 | 11/1984 |
| DE | 3343601 | 6/1985 |
| DE | 8604004 | 4/1986 |
| DE | 3512204 | 10/1986 |
| DE | 3544845 | 6/1987 |
| DE | 3631390 | 12/1987 |
| DE | 3640822 | 6/1988 |
| DE | 8600241 | 4/1989 |
| DE | 2502992 | 7/1991 |
| DE | 4002547-0 | 8/1991 |
| DE | 3932980 | 11/1991 |
| DE | 9300306 | 3/1993 |
| DE | 4134452 | 4/1993 |
| DE | 4215273 | 11/1993 |
| DE | 4242530 | 6/1994 |
| DE | 43 44 089 | 7/1994 |
| DE | 9317191 | 3/1995 |
| DE | 296 14 086 | 10/1996 |
| DE | 29703962 | 6/1997 |
| DE | 29710175 | 8/1997 |
| DE | 29711960 | 10/1997 |
| DE | 19651149 | 6/1998 |
| DE | 19709641 | 9/1998 |
| DE | 19821938 | 11/1999 |
| DE | 20001225 | 7/2000 |
| DE | 19925248 | 12/2000 |
| DE | 20018284 | 1/2001 |
| DE | 20017461 | 2/2001 |
| DE | 20027461 | 3/2001 |
| DE | 100 01 076 | 10/2001 |
| DE | 517353 | 5/2002 |
| DE | 10062873 | 7/2002 |
| DE | 10131248 | 1/2003 |
| DE | 10 2005 002 297.9 | 8/2005 |
| DE | 20 2009 004 530 | 6/2006 |
| DE | 10 2007 035 648 | 1/2009 |
| DE | 2009 022 483.1 | 5/2009 |
| DE | 10 2010 004717.1 | 1/2010 |
| DE | 10 2009 038 750 | 3/2011 |
| EP | 0085196 | 8/1983 |
| EP | 0248127 | 12/1987 |
| EP | 0220389 | 5/1992 |
| EP | 0623724 | 11/1994 |
| EP | 0652340 | 5/1995 |
| EP | 0698162 | 2/1996 |
| EP | 000711886 | 5/1996 |
| EP | 813641 | 12/1997 |
| EP | 0843763 | 5/1998 |
| EP | 0849416 | 6/1998 |
| EP | 0855482 | 7/1998 |
| EP | 0877130 | 11/1998 |
| EP | 0903451 | 3/1999 |
| EP | 0958441 | 11/1999 |
| EP | 0969163 | 1/2000 |
| EP | 0969164 | 1/2000 |
| EP | 0974713 | 1/2000 |
| EP | 1229181 | 8/2002 |
| EP | 2400076 | 8/2004 |
| EP | 2 034 106 | 3/2009 |
| FI | 843060 | 8/1984 |
| FR | 557844 | 8/1923 |
| FR | 1175582 | 3/1959 |
| FR | 1215852 | 4/1960 |
| FR | 1293043 | 5/1962 |

(56) References Cited

FOREIGN PATENT DOCUMENTS

| | | | |
|---|---|---|---|
| FR | 2568295 | 1/1986 | |
| FR | 2630149 | 10/1989 | |
| FR | 2637932 | 4/1990 | |
| FR | 2675174 | 10/1992 | |
| FR | 2691491 | 11/1993 | |
| FR | 2691691 | 11/1993 | |
| FR | 2891491 | 11/1993 | |
| FR | 2697275 | 4/1994 | |
| FR | 2712329 | 5/1995 | |
| FR | 2781513 | 1/2000 | |
| FR | 2785633 | 5/2000 | |
| FR | 2810060 | 12/2001 | |
| GB | 424057 | 2/1935 | |
| GB | 585205 | 1/1947 | |
| GB | 599793 | 3/1948 | |
| GB | 636423 | 4/1950 | |
| GB | 812671 | 4/1959 | |
| GB | 0812671 | 4/1959 | |
| GB | 1212983 | 11/1970 | |
| GB | 1237744 | 6/1971 | |
| GB | 1348272 | 3/1974 | |
| GB | 1430423 | 3/1976 | |
| GB | 2117813 | 10/1983 | |
| GB | 2126106 | 3/1984 | |
| GB | 2142670 | 1/1985 | |
| GB | 2168732 | 6/1986 | |
| GB | 2228753 | 9/1990 | |
| GB | 2243381 | 10/1991 | |
| GB | 2256023 | 11/1992 | |
| IT | 812671 | 4/1959 | |
| JP | 5465528 | 5/1979 | |
| JP | 57119056 | 7/1982 | |
| JP | 64-14838 | 1/1989 | |
| JP | 64-14839 | 1/1989 | |
| JP | 1178659 | 7/1989 | |
| JP | 02285145 | 11/1990 | |
| JP | 3-18343 | 2/1991 | |
| JP | 3-44645 | 4/1991 | |
| JP | 3046645 | 4/1991 | |
| JP | 3169967 | 7/1991 | |
| JP | 4106264 | 4/1992 | |
| JP | 4191001 | 7/1992 | |
| JP | 5148984 | 6/1993 | |
| JP | 6-146553 | 5/1994 | |
| JP | 656310 | 8/1994 | |
| JP | 6320510 | 11/1994 | |
| JP | 752103 | 2/1995 | |
| JP | 407052103 | 2/1995 | |
| JP | 7076923 | 3/1995 | |
| JP | 7180333 | 7/1995 | |
| JP | 7229276 | 8/1995 | |
| JP | 7279366 | 10/1995 | |
| JP | 7-300979 | * 11/1995 | ..... E04F 15/04 |
| JP | 7300979 | 11/1995 | |
| JP | 7310426 | 11/1995 | |
| JP | 8086078 | 4/1996 | |
| NL | 7601773 | 2/1975 | |
| NO | 157871 | 7/1984 | |
| NO | 3305614 | 5/1995 | |
| PL | 26931 | 6/1989 | |
| SE | 812671 | 4/1959 | |
| SE | 372051 | 12/1974 | |
| SE | 7114900-9 | 12/1974 | |
| SE | 7706470 | 12/1978 | |
| SE | 450141 | 6/1987 | |
| SE | 8206934-5 | 6/1987 | |
| SE | 457737 | 1/1989 | |
| SE | 462809 | 4/1990 | |
| SE | 467150 | 6/1992 | |
| SE | 93015956 | 5/1993 | |
| SE | 501014 | 10/1994 | |
| SE | 502994 | 9/1996 | |
| SE | 503861 | 9/1996 | |
| SE | 509059 | 11/1998 | |
| SE | 509060 | 11/1998 | |
| SE | 512290 | 2/2000 | |
| SE | 512313 | 2/2000 | |
| SE | 513189 | 7/2000 | |
| SE | 514645 | 3/2001 | |
| SE | 0001149 | 10/2001 | |
| SU | 363795 | 11/1973 | |
| WO | WO 80/02155 | 10/1980 | |
| WO | WO 84/02155 | 6/1984 | |
| WO | WO 8703839 | 7/1987 | |
| WO | WO 9217657 | 10/1992 | |
| WO | WO 93/13280 | 7/1993 | |
| WO | WO 9313280 | 7/1993 | |
| WO | WO 9401628 | 1/1994 | |
| WO | WO 94/26999 | 11/1994 | |
| WO | WO 9426999 | 11/1994 | |
| WO | WO 96/12857 | 5/1996 | |
| WO | WO 96/23942 | 8/1996 | |
| WO | WO 9627719 | 9/1996 | |
| WO | WO 9627721 | 9/1996 | |
| WO | WO 9630177 | 10/1996 | |
| WO | WO 97/47834 | 12/1997 | |
| WO | WO 9747834 | 12/1997 | |
| WO | WO 9822678 | 5/1998 | |
| WO | WO 9824994 | 6/1998 | |
| WO | WO 9824995 | 6/1998 | |
| WO | WO 9858142 | 12/1998 | |
| WO | WO 9901628 | 1/1999 | |
| WO | WO 9940273 | 8/1999 | |
| WO | WO 99/66151 | 12/1999 | |
| WO | WO99/66151 | * 12/1999 | |
| WO | WO 9966151 | 12/1999 | |
| WO | WO 9966152 | 12/1999 | |
| WO | WO 0006854 | 2/2000 | |
| WO | WO 00/20705 | 4/2000 | |
| WO | WO 00/47841 | 8/2000 | |
| WO | WO 0056802 | 9/2000 | |
| WO | WO 00/63510 | 10/2000 | |
| WO | WO 0063510 | 10/2000 | |
| WO | WO 0066856 | 11/2000 | |
| WO | WO 01/02669 | 1/2001 | |
| WO | WO 0002214 | 3/2001 | |
| WO | WO 0120101 | 3/2001 | |
| WO | WO 01/31141 | 5/2001 | |
| WO | WO 01/51732 | 7/2001 | |
| WO | WO 01/51733 | 7/2001 | |
| WO | WO 01/75247 | 10/2001 | |
| WO | WO 02/081843 | 10/2002 | |
| WO | WO 03/083234 | 10/2003 | |
| WO | WO 03093686 | 11/2003 | |
| WO | WO 2005/040521 | 5/2005 | |
| WO | WO 2005/054599 | 6/2005 | |
| WO | WO 2005/059269 | 6/2005 | |
| WO | WO 2006/043893 | 4/2006 | |
| WO | WO 2007/008139 | 1/2007 | |
| WO | WO 2007/089186 | 8/2007 | |
| WO | WO 2007/141605 | 12/2007 | |
| WO | WO 2008004960 | 1/2008 | |
| WO | WO 2008/068245 | 6/2008 | |
| WO | WO 2009/066153 | 5/2009 | |
| WO | WO 2009/139687 | 11/2009 | |
| WO | WO 2010/082171 | 7/2010 | |
| WO | WO 2010/136171 | 12/2010 | |
| WO | WO 2011/085788 | 7/2011 | |

OTHER PUBLICATIONS

U.S. Appl. No. 09/988,014, filed Nov. 2001.
U.S. Appl. No. 09/770,395, filed Jan. 2001.
U.S. Appl. No. 10/158,945, filed Jun. 2002.
U.S. Appl. No. 09/672,076, filed Jul. 2000.
Non-Final Office Action for U.S. Appl. No. 13/437,597 dated Jul. 9, 2012.
Non-Final Offcie Action for U.S. Appl. No. 12/010,587 dated Oct. 10, 2012.
Pending U.S. Appl. No. 09/672,077.
Pending U.S. Appl. No. 09/988,014.
Pending U.S. Appl. No. 09/770,395.
Pending U.S. Appl. No. 10/158,945.

(56) References Cited

OTHER PUBLICATIONS

Pending U.S. Appl. No. 09/672,076.
Knight's American Mechanical Dictionary, vol. III. 1876, definition of scarf.
Traditional Details; For Building Restoration, Renovation, and Rehabilitation: From the 1932-1951 Editions of Architectvral Graphic Standards; John Wiley & Sons, Inc.
Traindustrins Handbok "Snickeriarbete", Knut Larsson, Tekno's Handbocker Publikation 12-11 (1952).
Elements of Rolling Practice; The United Steel Companies Limited Sheffield, England, 1963; pp. 116-117.
Die mobile; Terbrack; 1968.
High-Production Roll Forming; Society of Manufacturing Engineers Marketing Services Depmiment; pp. 189-192; George T. Halmos; 1983.
Fundamentals of Building Construction Materials and Methods; Copyright 1985; pp. 11.
Automated Program of Designing Snap-fits; Aug. 1987; pp. 3.
Plastic Part Technology; 1991; pp. 161-162.
Technoscope; Modern Plastics, Aug. 1991; pp. 29-30.
Encyclopedia of Wood Joints; A Fine Woodworking Book; pp. 1-151; 1992.
Whittington's Dictionary of Plastics; Edited by James F. Carley, Ph.D., PE; pp. 443, 461; 1993.
Patent Mit Inter-nationalem, Die Revolution ((von Grund auf)) Fibo-Trespo, Disstributed at the Domotex fair in Hannover, Germany in Jan. 1996.
Wood Handbook; Forest Products Laboratory, 1999; "Glossary pp. G-1 to 0-14", "Chapter 10, pp. 10-1 to 10-31".
Focus, Information Till Ana Medabetare, Jan. 2001, Kahrs pa Domotex I Hmmover, Tysklm1d, Jan. 13-16, 2001.
Search Report dated Apr. 21, 2001.
Letter to the USPTO dated May 14, 2002, regarding U.S. Appl. No. 90/005,744.
Non-Final Office Action for U.S. Appl. No. 10/270,163 dated Dec. 10, 2004.
Final Office Action for U.S. Appl. No. 10/270,163 dated Jun. 2, 2005.
Non-Final Office Action for U.S. Appl. No. 10/270,163 dated Dec. 14, 2005.
Final Office Action for U.S. Appl. No. 10/270,163 dated May 25, 2006.
Non-Final Office Action for U.S. Appl. No. 11/185,724 dated Sep. 26, 2006.
Non-Final Office Action for U.S. Appl. No. 11/483,636 dated Oct. 11, 2006.
Reexamination No. 90/007,366 dated Oct. 24, 2006.
Reexamination No. 90/007,526 dated Dec. 5, 2006.
Non-Final Office Action for U.S. Appl. No. 11/185,724 dated Apr. 19, 2007.
Non-Final Office Action for U.S. Appl. No. 11/483,636 dated Apr. 19, 2007.
Non-Final Office Action for U.S. Appl. No. 11/015,741 dated Sep. 6, 2007.
Non-Final Office Action for U.S. Appl. No. 11/242,127 dated Nov. 1, 2007.
Non-Final Office Action for U.S. Appl. No. 11/185,724 dated Jan. 9, 2008.
Final Office Action for U.S. Appl. No. 11/015,741 dated Feb. 26, 2008.
Non-Final Office Action for U.S. Appl. No. 11/483,636 dated Apr. 3, 2008.
Non-Final Office Action for U.S. Appl. No. 11/242,127 dated Apr. 29, 2008.
United States District Court Eastern District of Wisconsin; Order; Dated May 1, 2008.
Examiner Interview Summary for U.S. Appl. No. 11/015,741 dated May 7, 2008.
Final Office Action for U.S. Appl. No. 11/185,724 dated Jul. 9, 2008.
Non-Final Office Action for U.S. Appl. No. 10/580,191 dated Jul. 16, 2008.
Reexamination No. 90/007,365 dated Aug. 5, 2008.
United States District Court Eastern District of Wisconsin; Judgment; Dated Oct. 10, 2008.
United States District Court Eastern District of Wisconsin; Order; Dated Oct. 10, 2008.
Final Office Action for U.S. Appl. No. 11/483,636 dated Nov. 20, 2008.
United States District Court Eastern District of Wisconsin; Order; Dated Dec. 31, 2008.
Non-Final Office Action for U.S. Appl. No. 11/242,127 dated Mar. 31, 2009.
Non-Final Office Action for U.S. Appl. No. 11/483,636 dated Jul. 21, 2009.
Examiner Interview Summary for U.S. Appl. No. 11/185,724 dated Aug. 13, 2009.
Non-Final Office Action for U.S. Appl. No. 12/278,274 dated Sep. 24, 2009.
Final Office Action for U.S. Appl. No. 11/242,127 dated Nov. 24, 2009.
United States Court of Appeals for Federal Circuit; 2009-1107,-1122; Decided: Feb. 18, 2010.
Appeals from the United States District Court for the Eastern District of Wisconsin; Consolidated case No. 02-CV-0736 and 03-CV-616; Judge J.P. Stadtmueller, 2009-1107,-1122. Revised Feb. 25, 2010.
Non-Final Office Action for U.S. Appl. No. 10/580,191 dated Mar. 10, 2010.
Non-Final Office Action for U.S. Appl. No. 11/483,636 dated Mar. 17, 2010.
United States Court of Appeals of the Federal Circuit; Case No. 02-CV-0736 and 03-CV-616; Mandate issued on Apr. 12, 2010; Judgment; 2 pages.
Final Office Action for U.S. Appl. No. 12/278,274 dated May 17, 2010.
Final Office Action for U.S. Appl. No. 10/580,191 dated Oct. 6, 2010.
Non-Final Office Action for U.S. Appl. No. 12/278,274 dated Nov. 2, 2010.
Non-Final Office Action for U.S. Appl. No. 11/483,636 dated Dec. 7, 2010.
Final Office Action for U.S. Appl. No. 12/278,274 dated Apr. 14, 2011.
Final Office Action for U.S. Appl. No. 11/483,636 dated May 24, 2011.
Non-Final Office Action for U.S. Appl. No. 13/048,646 dated May 25, 2011.
Non-Final Office Action for U.S. Appl. No. 12/966,861 dated Jul. 20, 2011.
Non-Final Office Action for U.S. Appl. No. 12/979,086 dated Aug. 3, 2011.
Non-Final Office Action for U.S. Appl. No. 11/483,636 dated Sep. 28, 2011.
Decision revoking the European Patent EP-B-1 276 941 dated Oct. 21, 2011.
Final Office Action for U.S. Appl. No. 13/048,646 dated Nov. 1, 2011.
Final Office Action for U.S. Appl. No. 12/966,861 dated Jan. 20, 2012.
Final Office Action for U.S. Appl. No. 12/979,086 dated Jan. 25, 2012.
Final Office Action for U.S. Appl. No. 11/483,636 dated Feb. 7, 2012.
Non-Final Office Action for U.S. Appl. No. 12/966,797 dated Feb. 29, 2012.
Final Office Action for U.S. Appl. No. 13/204,481 dated Mar. 12, 2012.
Notice of Allowance for U.S. Appl. No. 12/966,861 dated Apr. 11, 2012.
Notice of Allowance for U.S. Appl. No. 12/979,086 dated Jul. 19, 2012.
Non-final Office Action for U.S. Appl. No. 12/747,454 dated Aug. 6, 2012.
Final Office Action for U.S. Appl. No. 12/966,797 dated Aug. 8, 2012.
Non-Final Office Action for U.S. Appl. No. 13/452,183 dated Aug. 8, 2012.

(56) References Cited

OTHER PUBLICATIONS

Non-Final Office Action for U.S. Appl. No. 13/204,481 dated Sep. 7, 2012.
Non-Final Office Action for U.S. Appl. No. 11/483,636 dated Oct. 10, 2012.
Advisory Action for U.S. Appl. No. 12/966,797 dated Oct. 18, 2012.
European Office Action dated Oct. 19, 2012.
Notice of Allowance for U.S. Appl. No. 13/437,597 dated Oct. 26, 2012.
Non-Final Office Action for U.S. Appl. No. 13/086,931 dated Nov. 7, 2012.
Non-Final Office Action for U.S. Appl. No. 13/492,512 dated Nov. 21, 2012.
Non-Final Office Action for U.S. Appl. No. 13/463,329 dated Nov. 21, 2012.
Notice of Allowance for U.S. Appl. No. 11/483,636 dated Nov. 23, 2012.
Notice of Allowance for U.S. Appl. No. 10/270,163 dated Dec. 13, 2012.
Non-Final Office Action for U.S. Appl. No. 12/966,797 dated Dec. 13, 2012.
Non-Final Office Action for U.S. Appl. No. 13/559,230 dated Dec. 20, 2012.
Non-Final Office Action for U.S. Appl. No. 13/675,936 dated Dec. 31, 2012.
Notice of Allowability for U.S. Appl. No. 11/483,636 dated Jan. 3, 2013.
Notice of Allowance for U.S. Appl. No. 12/747,454 dated Jan. 8, 2013.
Notice of Allowance for U.S. Appl. No. 13/437,597 dated Jan. 9, 2013.
Non-Final Office Action for U.S. Appl. No. 13/620,098 dated Feb. 8, 2013.
Final Office Action for U.S. Appl. No. 13/204,481 dated Feb. 25, 2013.
Non-Final Office Action for U.S. Appl. No. 13/492,512 dated Feb. 26, 2013.
Non-Final Office Action for U.S. Appl. No. 11/015,741 dated Mar. 13, 2013.
Final Office Action for U.S. Appl. No. 13/567,933 dated Mar. 15, 2013.
Notice of Allowance for U.S. Appl. No. 11/242,127 dated Apr. 26, 2013.
Notice of Allowance for U.S. Appl. No. 13/437,597 dated Apr. 29, 2013.
Non-Final Office Action for U.S. Appl. No. 12/747,454 dated May 10, 2013.
Notice of Allowance for U.S. Appl. No. 11/185,724 dated May 20, 2013.
Non-Final Office Action for U.S. Appl. No. 13/559,242 dated Jun. 7, 2013.
Applicant-Iniated Interview Summary for U.S. Appl. No. 13/204,481 dated Jul. 29, 2013.
Architectvral Graphic Standards; Jolm Wiley & Sons, Inc.
Bojlesystemet til Junckers boliggulve, Junckers Trae for Livet.
CLIC, Ali-Nr, 110 11 640.
Fibolic Brochure, undated.
Fiboloc Literature, Mar. 1999.
FN Neuhofer Holz, "Profiles in various kinds and innovative accessories"; Certified according to DIN EN ISO 9002.
Haro Wand und Decke.
Hot Rolling of Steel; Library of Congress Cataloging in Publication Data; Roberts, William L; p. 189.
International Search Report.
Laminat-Boden, Clever-Clickq.
New Software Simplifies Snap-Fit Design; Design News; p. 148.
Opplaering OG Autorisasjon, Fibo-Trespo, ALLOC, Lmninatgulvet som Legges Uter Lin.
Original Pergo the Free and Easy Floor.
Pergo, Clic Flooring, Laminatgolv.
Plastic Product Design; Van Nostrand Reinhold Company; pp. 256-258.
Special Verdict, Civil Case No. 02-C-0736.
The Clip System for Junckers Sports Floors, Junckers Solid Hardood Flooring, Almex 7, p. 1/2.
The Clip System for Junckers Sports Floors, Junckers Solid Hardood Flooring, Annex 8, p. 1/4.
Time Life Books; "Floors, Stairs, Carpets," p. 14.
Trabearbetning Anders Gronhmd, TralelmikCentrum.
Trae Pjecer; pp. 1-35.
United States District Court Eastern of Wisconsin; Pervan Testimony; Trial Day 5 (Official Transcript); pp. 1101-1292.
United States District Court North Carolina; *Pergo* (*Europe*) *AB* v *Unilin Beheer BV*, Civil. Action No. 5:08-CV-91; Joint Stipulation of Dismissal.
United States District Court of North Carolina; *Pergo* (*Europe*) *AB* v *Unilin Beheer BV.* Civil Action No. 5:08-CV-91-H3; Plantiffs Original Complaint for Patent Infringement.
United States District Court of North Carolina; *Pergo* (*Europe*) *Ab* v *Unilin Beheer BV.* Civil Action No. 5:08-CV-91-H3: Answer and Counterclaim of Defendant.
Valinge Innovation AB; "Choosing the Locking System".
Webster's, Dictionary, p. 862, definition of scarf.

* cited by examiner

PROCESS FOR SEALING OF A JOINT

CROSS-REFERENCE TO RELATED APPLICATIONS

This application is a divisional application of U.S. patent application Ser. No. 10/242,674, filed Sep. 13, 2002, now U.S. Pat. No. 7,332,053; which in turn is a continuation-in-part of U.S. patent application Ser. No. 09/988,014, filed Nov. 16, 2001 now abandoned, which in turn, is a continuation-in-part application of U.S. patent application Ser. No. 09/672,076, filed Sep. 29, 2000 now U.S. Pat. No. 6,591,568, claiming priority of Swedish Application No. 0001149-4, filed Mar. 31, 2000; the entire disclosures of which are incorporated hereby by reference in their entirety.

BACKGROUND OF THE INVENTION

1. Field of the Invention

The present invention relates to sealing of a joint comprising mechanical locking.

2. Description of the Prior Art

Prefabricated surface elements which at their edges are provided with groove and tenon are well known nowadays. As these are very easy to install it is possible for the normal handy man to achieve this. Such elements can be constituted of massive wood, fibre board or particle board. These are often provided with a surface layer, such as lacquer or some sort of laminate. The boards are most often installed by gluing them together via their groove and tenon. It is desired to join the separate elements so closely that the joint becomes practically invisible, which increases the moisture resistance radically. The usable life of the installed elements are thereby also increased. It is essential that glue is used excessively in order to achieve a tight joint. Any gaps will lead to moisture penetrating the joint with subsequent swelling of the core material closest to the joint. The glue also has to be used to an amount that it is spilled out through the joint on the decorative side of the surface elements. The superflous glue will of course have to be wiped off before beginning to set, which is rather time consuming.

One way of solving the problem is available on the market for some time now through different types of so-called click or snap-lock floor boards where no glue is to be used. The installation of such floor boards has become much swifter as no glue is required. The problems with these type of surface elements are that relatively small spills of fluids like water may cause great damage on the installed surface elements as well as subwalls and especially subfloors as the fluid will run through the joints rather rapidly due to the capillary effect. It is, of course, possible to use glue on these snap-lock type of elements as well although the problem with the time consuming cleaning during installation would remain.

BRIEF SUMMARY OF THE INVENTION

It has, through the present invention, been made possible to solve the above mentioned problems so that self sealing surface elements can be achieved. Accordingly the invention relates to a process for installation of surface elements. The surface elements comprising a core, a decorative upper surface and edges are provided with joining means for mechanically locking the surface elements together. The invention is characterised in that predetermined portions of the edges are provided with a glue which is present on the edges of the surface elements in a passive dry form and which may be activated by applying a liquid. The surface elements are thereby joined to each other by use of the joining means wherein a unit of a plurality of surface elements is formed. The glue is suitably a polyvinyl alcohol [PVA] glue. The glue is suitably applied on the edges as an emulsion which then is allowed to dry before the joining of the surface elements.

The liquid used for reactivating the glue is suitably water. The water is advantageously mixed with alcohol since this reduces the surface tension of the liquid as well as increasing the evaporation rate. A thin coat of the liquid is suitably applied on the installed surface elements wherein small amounts of the liquid will pentetrate into the joints thereby moisturising and activating the glue. The glue will thereby expand and merge over the edges of the joint and will act as sealant against further penetration of liquid. It is not necessary to actively activate the glue by applying the liquid over the installed surface elements as small amounts of liquid accidently spilt on the installed surface elements will pentetrate into the joints thereby moisturising and activating the glue so that the glue expands and merges over the edges of the joint thereby acting as a sealant against further penetration of liquid.

According to one embodiment of the invention the joining means comprises lower joining lips at two adjacent edges while the two remaining edges are provided with upper joining lips. The lower joining lips are provided with intrinsically vertical lower lip surfaces arranged parallel to the closest edge. The lower lip surfaces are adapted to interact with mainly vertical upper lip surfaces arranged on the upper joining lips so that two joined adjacent surface elements are locked together in a horizontal direction. The joining lips are furthermore are provided with at least one heel adapted to snap join with recesses which, by being provided with intrinsically horizontal locking surfaces, limits vertical movement between two joined adjacent surface elements. The surface elements are hereby assembled by being pressed downwards once the edges are vertically aligned.

According to another embodiment of the invention the surface elements comprises a combination of at least two different types of surface elements, which types comprise female surface elements and male surface elements, whereby:

a) The female surface element is provided with a female joining member on at least half of the number of its edges and a male joining member on less than half of the number of its edges.

b) The male surface element is provided with a male joining member on at least two thirds of the number of its edges and a female joining member on less than one third of the number of its edges.

c) An optional joining profile possibly constitutes a junction between two adjacent male joining members of two adjacent surface elements.

The female joining member comprises an upwards protruding lip, being parallel to the edge, with a guiding surface. The guiding surface faces the edge. The female joining member also comprises a locking groove, being parallel to the edge. The locking groove has a locking surface facing downwards, which locking surface terminates in a locking edge. An angle $\alpha I$ between the guiding surface and vertical plane is in the range 0-30° while an angle $\beta II$ between the locking surface and a horizontal plane also is in the range 0-30° as seen in a perpendicular cross-section.

The male joining member comprises a groove, being parallel to the edge, on the lower side with a guiding face. The guiding face faces away from the edge. The male joining member is also provided with a locking heel, being parallel to the edge The locking heel has a locking face facing upwards. An angle $\beta I$ between the guiding face and a vertical plane is in the range 0-30° while an angle βII between the locking face and a horizontal plane is also in the range 0-30° as seen in a perpendicular cross-section.

The possible joining profile comprises two upwards protruding rims, being parallel to each other and distanced from each other by a centre section. The two upwards protruding rims are provided with guiding areas, the guiding areas facing inwards. The joining profile is furthermore provided with two locking cheeks placed on an extension. The locking cheeks has locking areas facing downwards, which locking areas terminates in a locking edge. An angle ΨI between the guiding area and a vertical plane is in the range 0-30° while an angle ΨII between the locking area and a horizontal plane is in the range 0-30° as seen in a perpendicular cross-section. The angles αI and βI are mainly the same, the angles αII and βII are mainly the same and the angles ΨI and ΨII are mainly the same.

According to yet another embodiment of the invention the surface elements are joined by means of joining members. The edges are separated into a first and a second edge, which first and second edges are arranged on opposite sides, and a third and a fourth edge being adjacent to the first and the second edge and which third and fourth edges are arranged on sides opposite to one another. The surface elements are provided with male joining members on the first edge while the second edge of the surface elements are provided with a female joining member. The male joining member is provided with a tongue and a lower side groove, while the female joining member is provided with a groove and a cheek, the cheek being provided with a lip. The surface elements are joined together via the male and female joining members by tilting the surface element to be joined with an already installed surface element or a row of already installed floor elements, with the male joining member of the surface element angled downwards. The first edge is positioned mainly parallel to the second edge of the already installed surface element or row of surface elements. The tongue of the tilted surface element is then inserted into the groove of the female joining member of the already installed surface element or row of floor elements, whereby the tilted surface element is turned downwards, with its lower edge as a pivot axis, so that the lip eventually snaps into the lower side groove where the decorative upper layer of the surface elements are mainly parallel. The third and fourth edges of the surface elements are joined by means of joining members selected from the group consisting of:

a) The third edge of the surface elements are provided with a male vertical assembly joining member while the fourth edge is provided with a female vertical assembly joining member. The fourth edge is arranged on a side opposite to the third edge.

b) The third edge of the surface elements are alternatively provided with a male vertical assembly joining member while the fourth edge also is provided with a male vertical assembly joining member. The fourth edge is arranged on a side opposite to the third edge. The adjacent male vertical assembly joining members are joined by means of a separate vertical assembly joining profile.

Two adjacent edges of a surface element are at the same time, and in the same turning motion, joined with a surface element adjacent to the first edge and a surface element adjacent to the third or fourth edge.

These embodiments of the invention include:

The joint between two joined floor elements suitably also comprises cavities. According to one embodiment of the invention a snapping hook is constituted by a separate spring part which is placed in the cavity. Alternatively an undercut is constituted by a separate spring part which is placed in a cavity. The spring part is suitably constituted by an extruded thermoplastic profile, a profile of thermosetting resin or an extruded metal profile.

BRIEF DESCRIPTION OF THE DRAWINGS

Particular embodiments of the invention is described further in connection to enclosed drawings whereby.

DETAILED DESCRIPTION OF THE INVENTION

Figure 1:
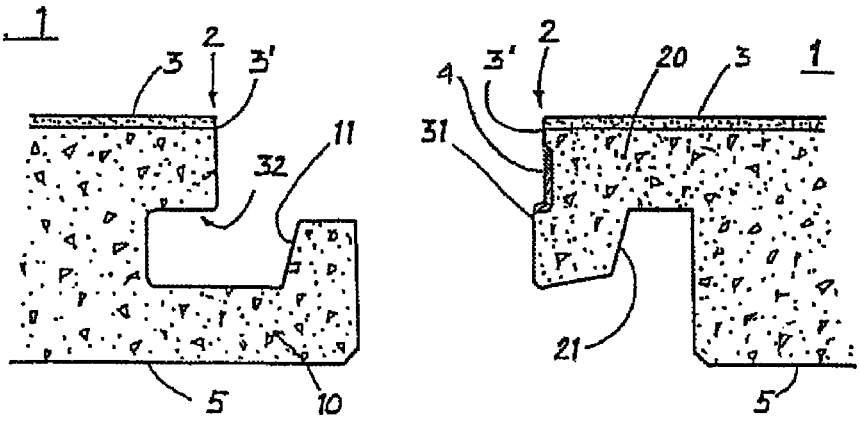
FIG. 1 shows a part of a surface element 1 according to a first embodiment of the invention.

FIG. 1 shows parts of a surface element 1. The surface elements 1 are provided with edges 2, a horizontal lower side 5, and a horizontal upper decorative surface 3. The surface elements 1 are at two adjacent edges 2 provided with lower joining lips 10 (only one shown) while the two remaining edges 2 are provided with upper joining lips 20 (only one shown). The lower joining lips 10 are provided with mainly vertical lower lip surfaces 11 arranged parallel to the closest edge 2. The lower lip surfaces 11 are intended to interact with mainly vertical upper lip surfaces 21 arranged on the upper joining lips 20 so that two joined adjacent surface elements 1 are locked together in a vertical direction. The joining lips 10 and 20, respectively, are furthermore provided with each one heel 31 with a matching recess 32. A vertical movement between two joined adjacent surface elements 1 is limited since the recess 32 and heel 31 respectively are provided with essentially horizontal locking surfaces. The joining surfaces are also provided with fitting surfaces $\mathbf{3}^{I}$ in order to avoid unintended gaps in the joint. The geometry of the joining edges are only shown schematically and may, of course, be changed in many ways within the scope of the invention.

Figure 2A:
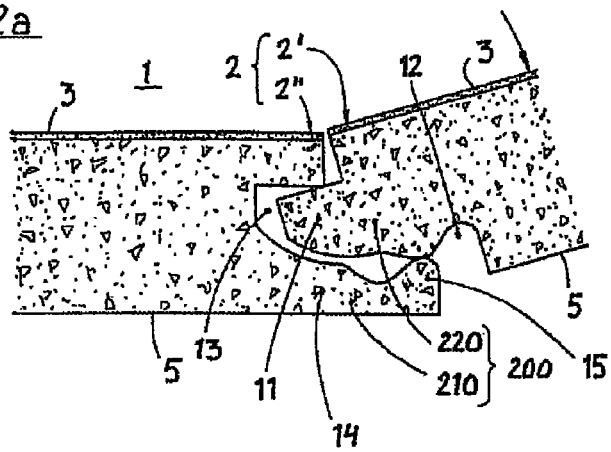
FIGS. 2*a-b* show a part of a surface element 1 according to a second embodiment of the invention.

FIG. 2*a* shows, in cross-section, a first and a second edge $\mathbf{2}^{I}$ and $\mathbf{2}^{II}$ respectively, during assembly. The figure shows parts of surface elements 1 with a mainly rectangular shape. The surface elements 1 are provided with edges 2, a lower side 5 and an upper decorative layer 3. The surface elements 1 are intended to be joined by means of joining members 200. The surface elements 1 are provided with male joining members 220 on a first edge $\mathbf{2}^{I}$ while a second edge $\mathbf{2}^{II}$ of the floor elements 1 are provided with a female joining member 210. The second edge 2*u* is arranged on a side opposite to the first edge $\mathbf{2}^{I}$. The male joining member 220 is provided with a tongue 110 and a lower side 5 groove 12. The female joining member 210 is provided with a groove 13 and a cheek 14, the cheek 14 being provided with a lip 15. The surface elements 1 are intended to mainly be joined together by tilting the surface elements 1 to be joined with an already installed surface elements 1 or a row of already installed surface elements 1, with the male joining member 220 of the surface elements 1 angled downwards and that the first edge $\mathbf{2}^{I}$ is allowed to be mainly parallel to the second edge $\mathbf{2}^{II}$ of the already installed surface element 1 or elements 1. The tongue 110 of the tilted surface element 1 is then inserted into the groove 13 of the female joining member 210 of the already installed surface element 1 or elements 1, whereby the tilted surface element 1 is turned downwards, with its lower edge 2 as a pivot axis, so that the lip 15 eventually falls into the lower side 5 groove 12 where the decorative upper layer 3 of the surface elements 1 are mainly parallel. The lip 15 and lower side 5 groove 12 are further provided with a cam 16 and a cam groove 17 which provides a snap action locking during the turning motion.

Figure 2B:
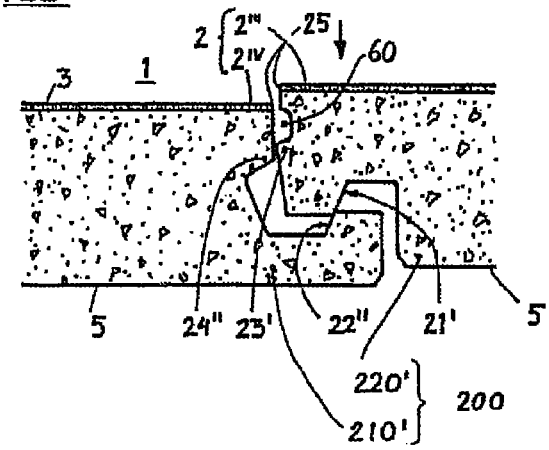

FIG. 2*b* shows, in cross-section, a third and a fourth edge $\mathbf{2}^{III}$ and $\mathbf{2}^{IV}$ respectively, of a surface element 1 according to the invention. The surface elements 1 are provided with a male vertical assembly joining member $\mathbf{220}^{I}$ on a third edge $\mathbf{2}^{III}$ while a fourth edge $\mathbf{2}^{IV}$ is provided with a female vertical assembly joining member $\mathbf{210}^{II}$. The fourth edge $\mathbf{2}^{IV}$ is placed on a side opposite to the third edge $\mathbf{2}^{III}$. The male vertical assembly joining members $\mathbf{220}^{I}$ are provided with mainly vertical lower cheek surfaces 21 arranged parallel to the closest edge 2. The lower cheek surfaces $\mathbf{21}^{I}$ are intended to interact with mainly vertical upper cheek surfaces $\mathbf{22}^{II}$ arranged on the female vertical assembly joining members $\mathbf{210}^{II}$ so that two joined adjacent surface elements 1 are locked against each other in a horizontal direction. The male vertical assembly joining members $\mathbf{220}^{II}$ are moreover provided with two snapping hooks $\mathbf{23}^{I}$ while the female vertical assembly joining members $\mathbf{210}^{II}$ are provided with matching under cuts $\mathbf{24}^{II}$, which by being provided with mainly horizontal locking surfaces limits the vertical movement between two joined adjacent surface elements 1.

The joint between a third and a fourth edge $\mathbf{2}^{III}$ and $\mathbf{2}^{IV}$, respectively, of two joined surface elements 1 further comprises contact surfaces which are constituted by the mainly horizontal locking surfaces of the under cut $\mathbf{23}^{I}$ and hook $\mathbf{24}^{II}$, the mainly vertical upper cheek surfaces $\mathbf{22}^{II}$ lower cheek surfaces $\mathbf{21}^{I}$ as well as upper mating surfaces 25. The joint between two joined surface elements 1 also comprises cavities 60.

Figure 4:
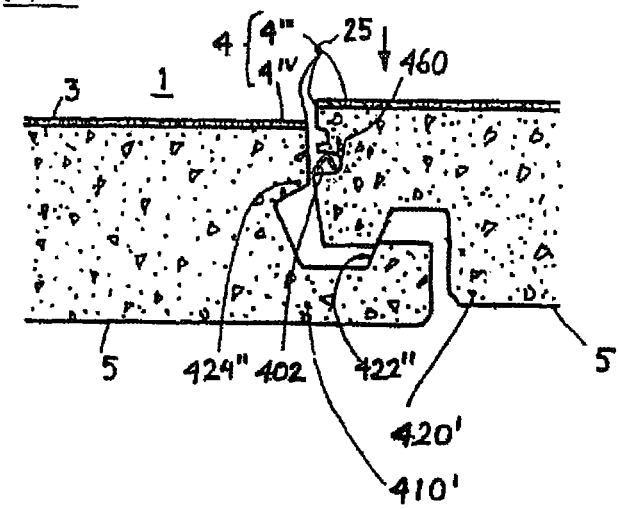
FIG. 4 shows the third and fourth edges of a surface element 1 according to the embodiment according to FIG. 2*a*.

As shown in FIG. 1, glue 4 may be included on at least one edge of surface element 1 and activated as heretofore described. Also, as shown in FIG. 4, which is an enlarged view of the third and an opposite fourth edges $\mathbf{4}^{III}$ and $\mathbf{4}^{IV}$, respectively, of surface element 1, a cavity 460 houses a spring part 402 placed in the cavity 460. The spring 402 acts as a hook to engage undercut $\mathbf{424}^{II}$. As with the heretofore described embodiment of FIG. 2*a*, the surface elements 1 of FIG. 4 have the same horizontal upper decorative surface 3, a horizontal lower side 5, and male vertical joining member $\mathbf{420}^{I}$ and female vertical joining member $\mathbf{410}^{I}$. When assembled, decorative surfaces 3, having upper mating surfaces 25, form a joint which is practically invisible.

FIGS. 3*a*, 3*b*, 3*c* and 3*d* are shown in exploded view and in cross-section. In an embodiment of joining members 1210 (FIG. 3*a*) and 1220 (FIG. 3*b*) respectively for surface elements $\mathbf{111}^{I}$, $\mathbf{111}^{II}$ according to the invention, before the assembly the surface elements $\mathbf{111}^{I}$, $\mathbf{111}^{II}$ which are assembled vertically, have a rectangular shape, as seen from above. The surface elements $\mathbf{111}^{I}$, $\mathbf{111}^{II}$ are provided with edges 112, $\mathbf{112}^{I}$ which are provided with joining members 1210, 1220. The surface elements $\mathbf{111}^{I}$, $\mathbf{111}^{II}$ are further provided with a lower sides 115, $\mathbf{115}^{I}$ and decorative top surfaces 113, $\mathbf{113}^{I}$. The surface elements $\mathbf{111}^{I}$, $\mathbf{111}^{II}$ comprise a combination of at least two types of surface elements, which types comprises female surface elements $\mathbf{1111}^{I}$ and male surface elements $\mathbf{111}^{II}$.

The female surface element $\mathbf{111}^{I}$ is provided with a female joining member 1210 on at least half of the number of its edges 112 and a male joining member 1220 on less than half of the number of its edges $\mathbf{112}^{I}$. The female joining member 1210 comprises an upwards protruding lip 1211, being parallel to the edge 112. The upwards protruding lip 1211 is provided with a guiding surface 1212, the guiding surface 1212 facing the edge 112, and a locking groove 1213, being parallel to the edge 112. The locking groove 1213 has a locking surface 1214 facing downwards, which locking surface 1214 terminates in a locking edge 1215. An angle αI (FIG. 3*b*) between the guiding surface 1212 and a vertical plane is 10°, while the angle αII (FIG. 3*b*) between the locking surface 1214 and a horizontal plane is 15° as seen in a perpendicular cross-section.

The male surface element $\mathbf{111}^{II}$ is provided with a male joining member 1220 on at least two thirds of the number of its edges 1121 and a female joining member 1210 on less than one third of the number of its edges 112.

The male joining member 1220 comprises a groove 1221, with a guiding face 1222, being parallel to the edge $\mathbf{112}^{I}$, on the lower side 115. The guiding face 1222 is facing away from the edge $\mathbf{112}^{I}$. The male joining member 1220 is also provided with a locking heel 1223, being parallel to the edge $\mathbf{112}^{I}$. The locking heel 1223 has a locking face 1224 facing upwards. An angle βI (FIG. 3*c*) between the guiding face 1222 and vertical plane is 10°, while an angle βII between the locking face 1224 and a horizontal plane is 15° as seen in a perpendicular cross-section.

Accordingly, the angles αI and 131 are the same and the angles αII and βII are also the same.

An optional joining profile 50 (see FIGS. 3*e* and 3*f*) may possibly constitute a junction between two adjacent male joining members 11220 of two adjacent surface elements $\mathbf{1111}^{I}$ and $\mathbf{1111}^{II}$.

The section placed between the edges 1112 and the grooves 1221 has a thickness which is less than the maximum surface element thickness by a recess 116 on the lower side 115 of the surface elements 1111. The thickness of the surface elements 111 is normally between 5 and 15 mm whereby a suitable depth of the recess 6 is 1-5 mm.

The width of the locking face 1224 is depending on aspects like the thickness of the surface element 111, the material used in the core, the dimensions of the part between the locking groove 1213 and the lower side 115 and the angles αI and βI chosen. The width of the locking face 1224 is typically less than 30% of the thickness of the surface element which normally is between 5 and 15 mm whereby the width is less than 4.5 mm for floors with 15 mm thickness and 2.1 mm for a common surface element with a thickness of 7 mm. It has, however shown to be fully sufficient with a width between 0.2 mm and 1 mm.

Figure 3A:
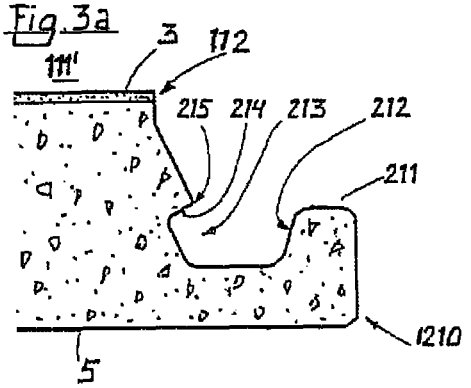
FIGS. 3*a-f* show a part of a surface element 1 according to a third embodiment of the invention.
Figure 3C:
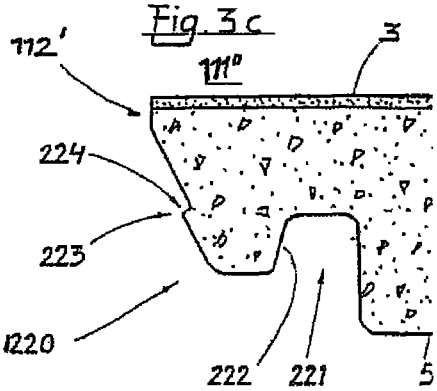
Figure 3B:
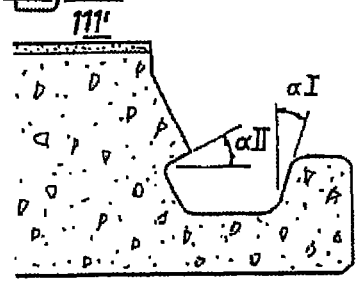
Figure 3D:
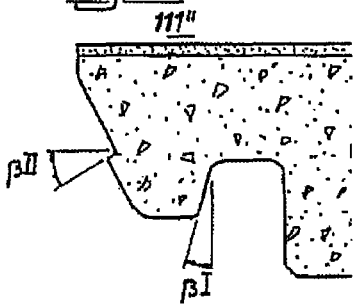
Figure 3E:
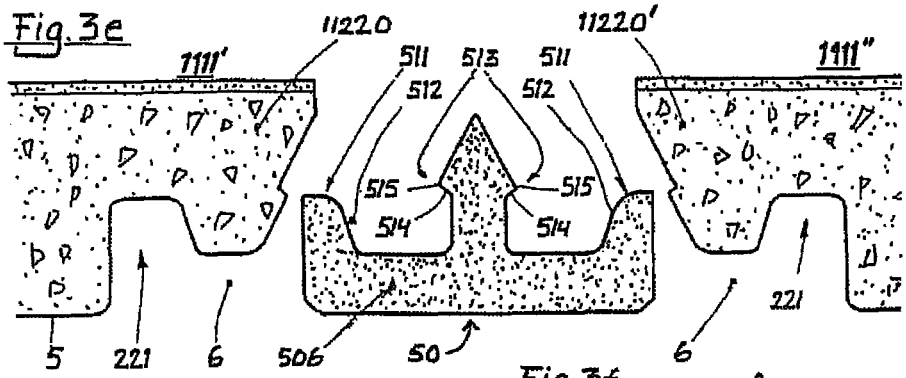
Figure 3F:
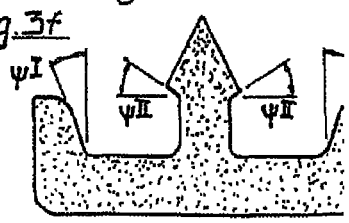

FIGS. 3*e* and 3*f* show, in cross-section, an embodiment of a joining profile 50 to a surface element $\mathbf{1111}^{I}$ and $\mathbf{1111}^{II}$ according to the invention. The joining profile 50 is intended to be used as a junction between two male joining members 11220 and $\mathbf{11220}^{I}$. The joining profile 50 comprises two upwards protruding rims 511, being parallel to each other and distanced from each other by a centre section 506. The two upwards protruding rims 511 are provided with guiding areas 512. The guiding areas 512 are facing inwards. The joining profile 50 is furthermore provided with two locking cheeks 513 placed on an extension 507. The locking cheeks 513 has locking areas 514 facing downwards, which locking areas 514 terminates in a locking edge 515. An angle ΨI between the guiding area 512 and the vertical plane is 10° and the angle ΨII between the locking area 514 and a horizontal plane is 15° as seen in a perpendicular cross-section.

Accordingly, the angles αI, βI (FIGS. 3*a*-3*d*) ΨI and are the same and the angles αII, βII (FIGS. 3*a*-3*d*) ΨII are also the same. In other embodiments of the invention the joint between two joined floor elements suitable also comprise cavities. According to one embodiment of the invention, the snapping hook, is constituted by a separate spring part which is placed in the cavity. Alternatively an undercut is constituted by a separate spring part which is placed in a cavity. The spring part is suitably made of an extended thermoplastic profile, a profile of thermosetting resin or a metal profile.

The invention is not limited by the embodiments shown since these can varied in different ways within the scope of the invention.

The invention claimed is:

1. A surface element designed to be assembled together with similar surface elements to form a plurality of joined surface elements:

the surface element comprising a core, a decorative upper surface, an opposed lower surface and at least four edges disposed between the upper and lower surfaces;

the four edges comprising a first edge and a second edge defining a first pair of opposite sides, and a third edge and a fourth edge defining a second pair of opposite sides;

wherein the first edge of the surface element comprises a first male joining member and a second edge comprises a first female joining member;

the first male joining member comprising a tongue and the first female joining member comprising a groove;

the first male joining member and the first female joining member being configured such that two surface elements can be coupled and vertically as well as horizontally locked at respective edges by rotational movement;

wherein the third edge and the fourth edge comprise a snapping hook and undercut, one of the snapping hook or undercut being formed by a separate spring part; and wherein the third and fourth edges are adapted to connect with adjacent edges via vertical motion resulting in vertical as well as horizontal locking.

2. The surface element of claim 1 wherein the spring part is formed of thermoplastic.

3. The surface element of claim 1 wherein the spring part part is formed of thermosetting resin.

4. The surface element of claim 1 wherein the spring part is formed of metal.

5. The surface element of claim 1 wherein the spring part is configured to engage the undercut.

6. An assembled unit of the plurality of surface elements according to claim 1.

7. The surface element of claim 1 wherein the decorative upper surface comprises a laminate.

8. The product of claim 1 wherein the decorative upper surface comprises a lacquer.

9. The surface element of claim 1 wherein the snapping hook is formed by the spring part.

10. The surface element of claim 1 wherein the undercut is formed by the spring part.

11. The surface element of claim 1 wherein the joining members of all edges are configured such that concurrently with joining of the first and second edges by rotational movement, joining also simultaneously occurs of the third and fourth edges.

12. A product comprising installed surface elements, the surface elements comprising:

a core selected from at least one material from the group consisting of wood, particleboard and fiberboard;

a decorative upper surface, an opposed lower surface and edges, the edges being disposed between the upper and lower surfaces, the edges provided with at least one of a first and a second joining member for mechanically joining the surface elements together, wherein:

at least one of the first and the second joining members comprises a male joining member and at least one of the first and the second joining elements comprises a female joining member;

the male joining member comprises a tongue and lower side groove;

the female joining member comprises a groove and a cheek, the cheek being provided with a lip; and at least one of the edges comprising the female joining member further comprises a cavity, wherein the cavity comprises a separate spring part, wherein the surface elements are configured to connect to an adjacent edge via vertical motion, whereby adjacent surface elements are locked vertically and horizontally.

13. The product of claim 12, wherein the core is fiberboard.

14. The product of claim 12, wherein the core is wood.

15. The product of claim 12, wherein the core is particleboard.

* * * * *